United States Patent [19]

Lenay

[11] 4,074,689

[45] Feb. 21, 1978

[54] SPOOL VALVE DISTRIBUTOR

[75] Inventor: Daniel Lenay, Puteaux, France

[73] Assignee: Societe Anonyme des Establissements Jouvenel & Cordier, Rueil-Malmaison, France

[21] Appl. No.: 750,111

[22] Filed: Dec. 13, 1976

[30] Foreign Application Priority Data

Jan. 26, 1976 France ..... 76 01958

[51] Int. Cl.[2] ..... F17B 1/08

[52] U.S. Cl. ..... 137/270; 137/271

[58] Field of Search ..... 137/269, 270, 271

[56] References Cited

U.S. PATENT DOCUMENTS

| | | | |
|---|---|---|---|
| 3,298,460 | 1/1967 | Porter | 137/271 X |
| 3,487,848 | 1/1970 | Leibfritz | 137/271 |
| 3,565,101 | 2/1971 | Aslan | 137/270 |

*Primary Examiner*—Alan Cohan

*Attorney, Agent, or Firm*—Wenderoth, Lind & Ponack

[57] ABSTRACT

This spool-valve distributor, comprising a pair of pistons producing opposed actions and two end covers formed with passage means for the circulation of the piston control fluid, has an assembling face formed with grooves adapted to receive a seal or gasket interposed between said face and the base member rigidly connected to the hydraulic or pneumatic device actuated by the distributor, some of said grooves being provided with lateral ribs, whereby positioning the seal or gasket on one or the other side of the relevant rib permitting of sealing said distributor body in relation to base members of different standards and dimensions.

6 Claims, 13 Drawing Figures

180°
14
40
38
40'
36
34
16
42
A 13

SPOOL VALVE DISTRIBUTOR

The present invention relates to a spool-valve distributor comprising a pair of control pistons producing opposed actions and two end covers provided with circulation passages for the piston control fluid. In distributors of this type, one of the faces of the distributor body acts as a base plane for mounting said body on the base plate or like member rigidly connected to the hydraulic or pneumatic device actuated by the distributor. A suitable seal is interposed between said base plate and the distributor body base plane. This seal engages grooves formed in the base plane of the distributor. In hitherto known distributors of this character the base or mounting plane can receive only one base plate corresponding to different standards but having commensurate dimensions.

The present invention is directed to provide a spool-valve distributor comprising a base or mounting face so designed that it can fit to base plates of different standards but having non-commensurate dimensions by using the same seal or gasket.

For this purpose, the base face of the distributor according to this invention comprises in the known fashion grooves adapted to receive the seal or gasket interposed between the base of the controlled device and the distributor body, some of said grooves comprising lateral ribs. Thus, by fitting the seal or gasket on one or the other side of these ribs it is possible to ensure the fluid-tightness of the distributor body on base members having different standards and dimensions.

According to another feature of this invention molded seals are provided between the distributor body and the end covers and formed with holes registering with the monitoring ducts, said seals being adapted to act as means for selecting the monitoring ducts according to the position imparted to said seals; thus, turning each seal through 180° about each one of its axes will provide four different positions corresponding each to the obtaining of a specific monitoring circuit.

Each seal comprises tongues, tabs, lugs or the like on which the functions obtainable therewith are printed, so that this function can be read directly through a window provided in the distributor body. According to a modified embodiment, the symbols corresponding to the various functions obtainable are printed directly on the distributor body so that when a predetermined function is desired, it can be obtained by simply positioning the seal in such a manner that one of said tongues or tabs registers with the relevant symbol.

The distributor according to this invention is further characterized in that the spool-valve is actuated by means of a piston mounted in a ring adapted, when turned inside-out, to assume two positions in order to obtain two different mechanical functions, i.e. a piston function and a differential function.

Other features and advantages of this invention will appear as the following description proceeds with reference to the attached drawings illustrating diagrammatically by way of example typical forms of embodiment thereof. In the drawings.

Figure 1:
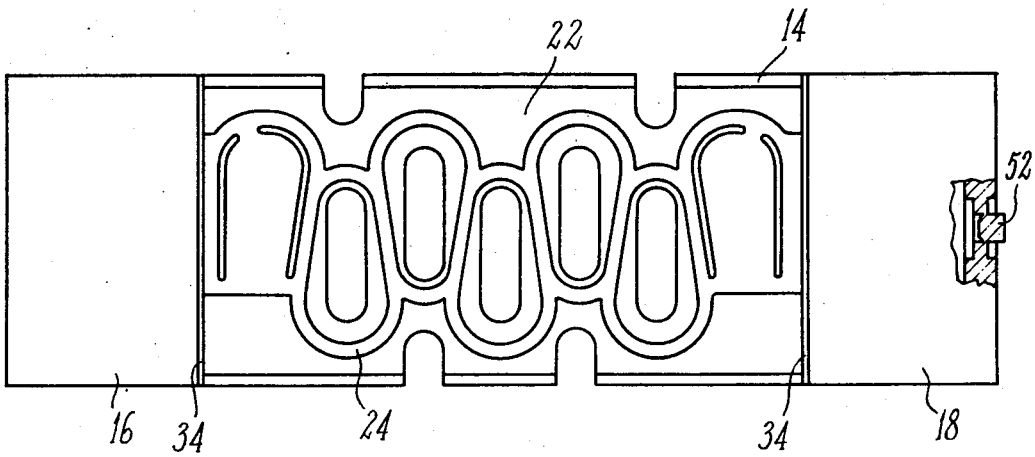
FIG. 1 is a diagrammatic plane view of a distributor according to this invention.
Figure 4:
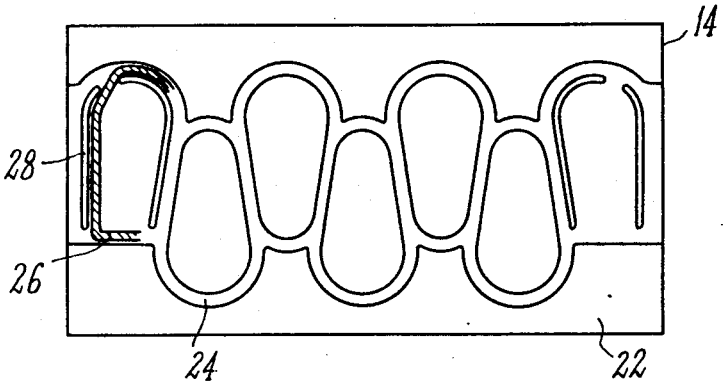
FIG. 4 is a plane view showing the mounting or base face of the distributor, illustrating one of the possible positions of the base seal or gasket.
Figure 7:
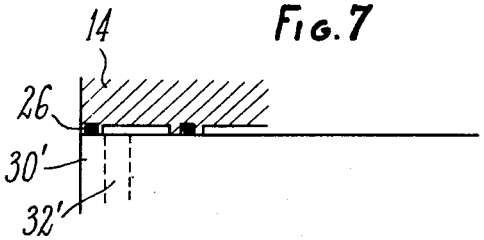

Referring first to FIGS. 1, 4 and 7 of the drawings, the body 14 of the spool-valve distributor shown therein comprises a pair of end covers 16 and 18, a seal 34 (to be described presently with reference to FIGS. 8 to 11) being interposed between each cover and the body. The bottom face 22 of the distributor body constitutes in the known manner the mounting or assembling face for connecting the distributor to the base plate solid with the device actuated by the distributor. This base or mounting face 22 has grooves 24 formed therein for receiving a seal or gasket 26. According to this invention, the recesses for a base seal are so shaped that a same distributor can be fitted by utilizing the same seal on base plates or supports made according to different standards and having different dimensions. For this purpose, some of the grooves 24 are associated with ribs 28. Thus, by positioning the seal 26 on one or the other side of these ribs, the distributor body can be made fluid-tight by using base plates or supports corresonding to different standards and dimensions.

Figure 5:
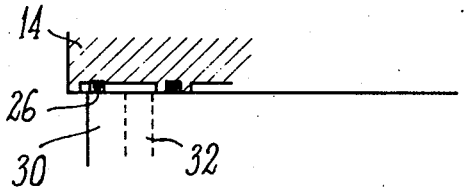
FIG. 5 is a fragmentary longitudinal section showing one of the seal positions between the distributor and the base plate or like support.

FIGS. 4 and 5 illustrate the position of the seal ensuring the desired fluid-tightness between the base face 22 of distributor body 14 and a base plate 30 having a length inferior to that of said distributor body 14. In this specific arrangement, the seal 26 is disposed internally of the rib 28. In FIG. 5 the reference numeral 32 designates diagrammatically the control orifice provided in said base plate or support 30.

Figure 6:
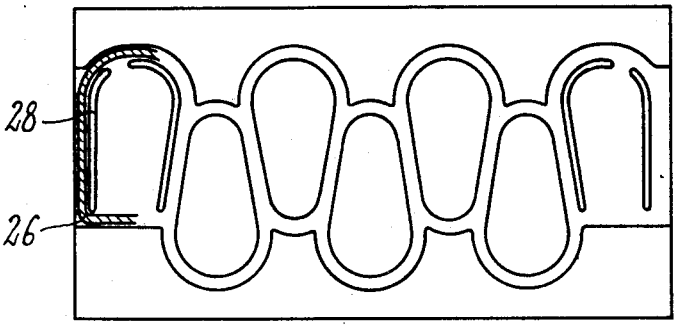
FIGS. 6 and 7 are views similar to FIGS. 4 and 5, respectively, showing the distributor of this invention associated with another type of base plate or like support.

In the assembly illustrated in FIGS. 6 and 7 the distributor according to the present invention is mounted on a base plate or member 30′ designed according to different standards in comparison with preceding examples, the control orifice 32′ lying slightly outside the minimum mounting face of the base corresponding to the preceding example. To provide the necessary fluid-tightness by utilizing the same seal 26, it is only necessary to engage the latter into the groove 24, behind or externally of the rib 28, as illustrated in FIG. 6.

As clearly apparent from the above description the distributor may, by using a single seal or gasket, be associated with two different base members by simply properly positioning said seal in relation to the ribs 28.

Reference will now be made to FIGS. 8 to 11 of the drawings showing a gasket 34 interposed between the distributor body 14 and each end cover 16, 18, in four different positions.

This gasket 34 has substantially the form of a grid having holes formed therein which register with the monitoring ducts 36, 38, this gasket 34 being formed with integral tabs or lugs 40, 40′. Preferably, this gasket is molded from light-colored elastomer. Turning this gasket inside-out or through 180° about its axes, as illustrated in the drawings, will provide four different positions corresponding each to a predetermined monitoring circuit (i.e. pneumatic monitoring: internal pressure, external pressure, and electropneumatic monitoring: internal pressure, external pressure).

Figures 8, 9, 10, 11, 12, 13:
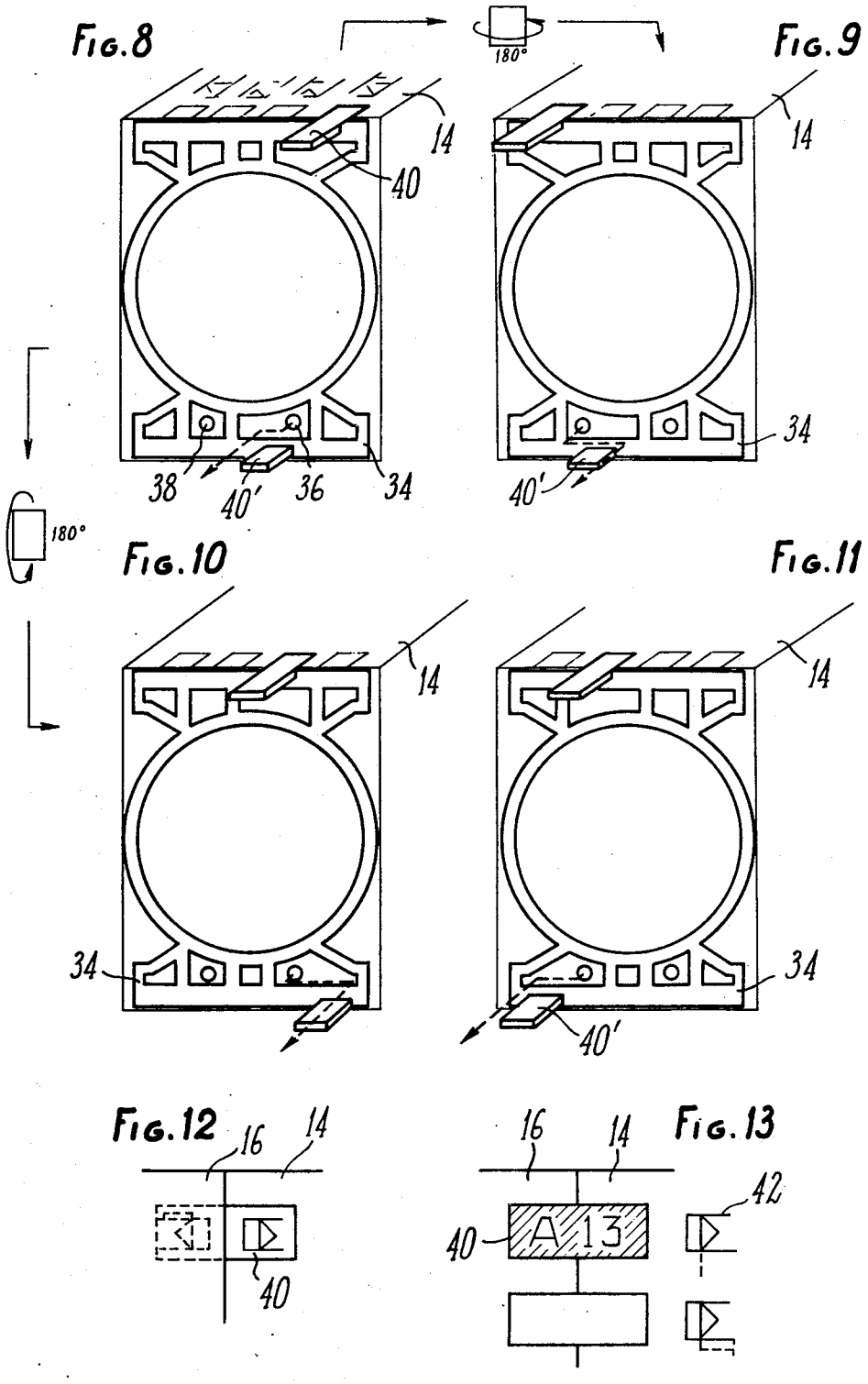
FIGS. 8 to 11 illustrate in perspective each one of the four positions in which the monitoring selecting seal or gasket can be set between the lateral faces of the distributor and the end covers.
FIGS. 12 and 13 illustrate in plane view two typical examples of the visualization of the distributor function obtained by changing the position of the monitoring seal.

In FIGS. 12 and 13 of the drawings, illustrating diagrammatically and partially in plane view the connection between an end cover 16 and the distributor body 14, two typical and exemplary embodiments of the visualization of the function obtained in each case are shown.

In the example of FIG. 12, the function obtained is printed directly on each relevant half-tab 40 and 40'. In the assembled condition only the tab concerned is visible through a window. In the form of embodiment shown in FIG. 13 the symbol 42 of the resultant function is printed on the distributor body by using any known and suitable method. For obtaining the desired function, it is only necessary to position the gasket 34 in such a manner that its tab 40 or 40' registers with the symbol 42 concerned. Of course, a reference mark may be made on the selector gasket.

By virtue of this characteristic feature of the present invention, a code-free display can be obtained by direct visualization of the desired function.

Figure 2:
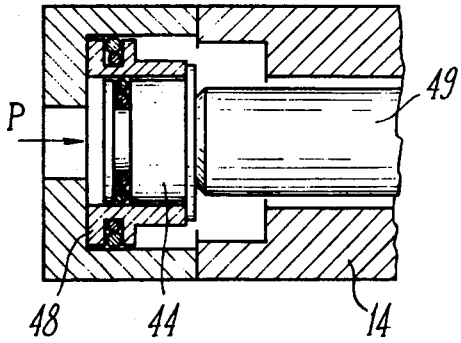
FIGS. 2 and 3 are fragmentary longitudinal sections showing spool-valve control means of the differential-piston type.
Figure 3:
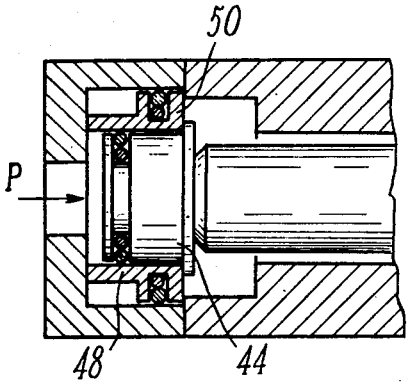

Reference will now be made to FIGS. 2 and 3 of the drawings which illustrate the means contemplated according to this invention for mechanically controlling the distributor spool-valve or movable member 49. These means comprise a piston 44 slidably mounted in a ring 48 adapted, by turning same inside out, to assume two different positions illustrated in these Figures.

In the mounting shown in FIG. 2 the mechanical piston function is obtained, the assembly comprising the piston 44 and ring 48 moving under the pressure P in the bore of the distributor. In the mounting of FIG. 3 the differential mechanical function is obtained. In this case, the ring 48 abuting with one end against the cover 16 and with the opposite end against the shoulder 50 of body 14 is held against movement. When the pressure P is applied to this piston the latter moves until it engages the inner shoulder of body 14. Thus, a differential system is obtained for controlling the spool-valve distributor.

Of course, it is also possible to fit the two members 44, 48 in different positions at the ends of distributor body 14, with due consideration for the desired functions.

On the right-hand portion of the distributor cover 18 illustrated in FIG. 1 there is shown in fragmentary section the lateral surface of said cover, which comprises a frangible stud 52. Breaking this stud 52 will open this cover face, thus permitting for example an electropneumatic monitoring of the distributor.

Of course, this invention should not be construed as being strictly limited by the specific forms of embodiment illustrated and described herein, since various modifications and changes may be brought thereto without departing from the basic principles thereof as recited in the appended claims.

What I claim is:

1. Spool-valve distributor of the type comprising a pair of control pistons operating in opposition to each other and two end covers provided with passage means for circulating the piston control fluid, wherein the assembling face of the body of said distributor comprises in a manner known per se grooves adapted to receive a seal interposed between the base member solid with the hydraulic or pneumatic device actuated by said distributor and the distributor body, some of said grooves being provided with lateral ribs, the positioning of said seal on one or the other side of said ribs permitting of sealing said distributor body with base members having different standards and dimensions.

2. Spool-valve distributor as recited in claim 1, wherein gaskets in the form of grids are provided between said distributor body and said end covers to constitute said seals, said gaskets comprising holes adapted to register with the monitoring ducts of said distributor, said gaskets being adapted to act as means for selecting the monitoring circuit, according to the position in which they are fitted to the distributor, whereby turning one of said gaskets, or both, through 180° about each one of their axes, will provide four different positions corresponding each to a specific monitoring circuit.

3. Spool-valve distributor as recited in claim 2, wherein each one of said gaskets is provided with a plurality of tabs.

4. Spool-valve distributor as recited in claim 3, wherein the function obtained by means of a predetermined position of said gasket is displayed, preferably by printing, on said tabs, whereby this function can be read directly through a window formed in said body.

5. Spool-valve distributor as recited in claim 3, wherein the symbols corresponding to each function are printed directly on the distributor body so that a predetermined function can be obtained by so positioning the gasket that one of the tabs thereof registers with a corresponding symbol.

6. Spool-valve distributor as recited in claim 5, wherein the spool valve is controlled by means of a piston slidably mounted in a ring member adapted, when turned inside out, to assume two different positions in order to provide two different mechanical functions, namely a piston function and a differential function.

* * * * *